US005351401A

United States Patent [19]

Werner

[11] Patent Number: 5,351,401

[45] **Date of Patent: * Oct. 4, 1994**

[54] APPARATUS FOR CUTTING OR SHAVING

[76] Inventor: Eric J. Werner, 705 Westminster Rd., Hermitage, Pa. 16148

[ * ] Notice: The portion of the term of this patent subsequent to Apr. 27, 2010 has been disclaimed.

[21] Appl. No.: 52,839

[22] Filed: Apr. 26, 1993

Related U.S. Application Data

[63] Continuation-in-part of Ser. No. 954,408, Sep. 29, 1992, Pat. No. 5,205,040, which is a continuation of Ser. No. 788,105, Nov. 5, 1991, abandoned.

[51] Int. Cl.[5] ..... B26B 21/00; B26B 19/28; B26B 19/30

[52] U.S. Cl. ..... 30/50; 30/42; 30/41

[58] Field of Search ..... 30/41, 41.5, 42, 50, 30/72, 77, 86, 346.56, 50; 604/309

[56] References Cited

U.S. PATENT DOCUMENTS

| | | | |
|---|---|---|---|
| 1,761,025 | 6/1930 | Schnieder | 604/309 |
| 3,948,265 | 4/1976 | Al Ani | 604/309 |
| 4,233,976 | 11/1980 | Dunshee | 604/309 |
| 4,868,982 | 9/1989 | McComas | 30/41 |
| 4,944,090 | 7/1990 | Sumnall | 30/41 |
| 5,205,040 | 4/1993 | Werner | 30/50 |

*Primary Examiner*—Richard K. Seidel
*Assistant Examiner*—Paul M. Heyrana, Sr.
*Attorney, Agent, or Firm*—Ansel M. Schwartz

[57] ABSTRACT

The present invention pertains to an apparatus for shaving. The apparatus for shaving comprises at least one blade having an essentially straight and essentially continuous cutting edge. The blade is comprised of a plurality of pliable blade segments aligned adjacent to each other to form the cutting edge such that each blade segment is capable of deflecting in a direction perpendicular to the cutting edge independently with respect to the other blade segments. The apparatus is also comprised of a rectangular shaped head which holds the blade in a desired orientation. Additionally, the apparatus is comprised of a handle connected to the head. Preferably, the head holds the blade such that the blade segments are freestanding and not prestressed. In an alternative embodiment, the head can include a styptic strip disposed along the length of the head in parallel with the cutting edge and above the cutting edge such that after the cutting edge passes over the shaving surface during shaving, the styptic strip passes over the surface. Additionally, the head can include a lubricating strip disposed along the length of the head in parallel with the cutting edge and below the cutting edge such that before the cutting edge passes over the surface during shaving, the lubricating strip passes over the surface. In another preferred embodiment, the apparatus can include a styptic stick. In an even more preferred embodiment, the blade can have a plurality of holes whose centers are in spaced relationship with the cutting edge. The present invention also pertains to an apparatus for cutting.

24 Claims, 4 Drawing Sheets

FIG. 2
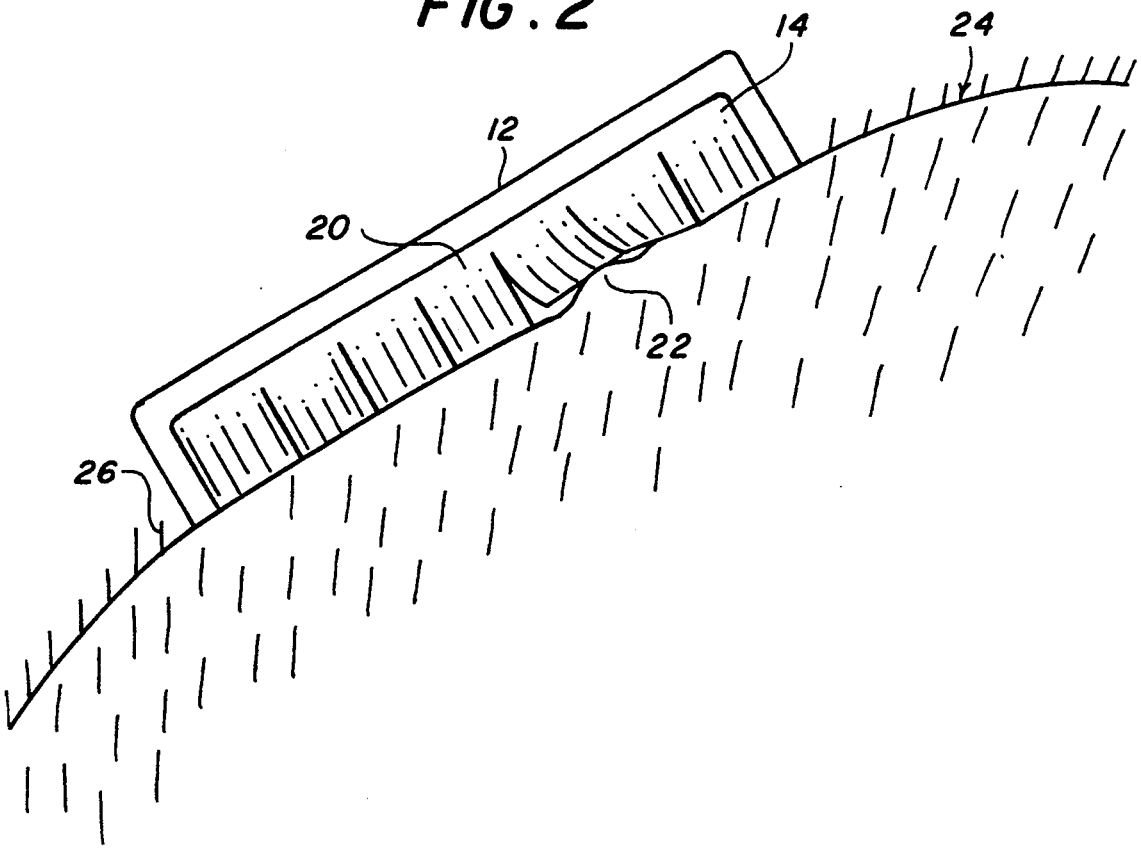
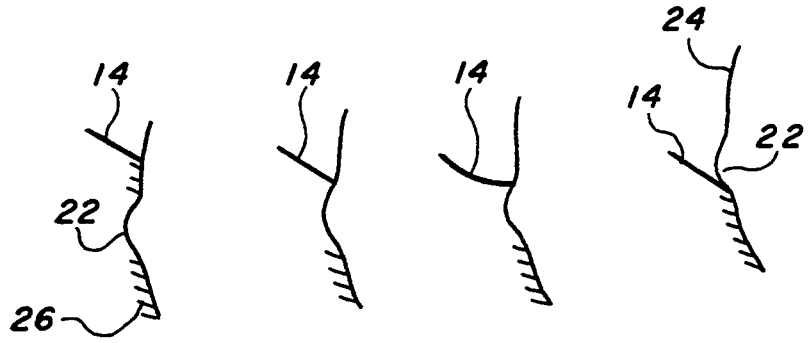
FIG. 3A FIG. 3B FIG. 3C FIG. 3D

APPARATUS FOR CUTTING OR SHAVING

CROSS-REFERENCE

This is a continuation-in-part of U.S. patent application Ser. No. 07/954,408 filed Sept. 29, 1992, and patented on Apr. 27, 1993, as U.S. Pat. No. 5,205,040, which is a continuation of U.S. patent application Ser. No. 07/788,105 filed Nov. 5, 1991, abandoned.

FIELD OF THE INVENTION

The present invention is related to an apparatus for shaving. More specifically, the present invention is related to an apparatus for shaving of the type in which portions thereof are movable during a shaving operation to effect dynamic changes in the shaving geometry of the unit.

BACKGROUND OF THE INVENTION

In some known shaving units, the shaving geometry, i.e., the spatial relationships between the blade and rigid portions of the razor head are fixed. U.S. Pat. No. 3,786,563, issued Jan. 22, 1974 to Francis W. Dorion, et al. is illustrative of this type of razor unit. In a second known category of shaving units, the shaving geometry is adjustable in that one or more of the portions of the unit may be re-positioned relative to the others, by the user, and remain in their new positions until selectively re-adjusted.

It has also been proposed to construct a shaving system with a cap member fixed relative to a handle and with blade and guard members made fast with each other and spring biased to a position of maximum blade exposure, the blade and guard members being adapted to retract against the spring bias upon encountering undue resistance during shaving. An arrangement of this sort is described in U.S. Pat. No. 4,063,354, issued Dec. 20, 1977 to Harry Pentney et al.

Several arrangements of shaving units permitting dynamic movement of various portions thereof during a shaving operation have been devised; examples of such contrivances are illustrated in U.S. Pat. Nos. 1,935,452 issued Nov. 14, 1933 to M. R. Kondolf; 2,313,818 issued Mar. 16, 1943 to H. J. Gaisman; 2,327,967 issued Aug. 24, 1943 to P. N. Peters; 2,915,817 issued Dec. 8, 1959 to E. Peck; 3,500,539 issued Mar. 17, 1970 to J. P. Muros; 3,657,810 issued Apr. 25, 1972 to W. I. Nissen; 3,685,150 issued Aug. 22, 1972 to F. L. Risher; and 3,740,841 issued Jun. 26, 1973 to F. L. Risher, as well as patents 3,880,284, 4,026,016, 4,168,571, 4,170,821, 4,270,268, 4,379,219, 4,492,024, 4,498,235, 4,551,916, 4,573,266, 4,586,255, 4,621,424 and 4,742,909, all of which are incorporated by reference.

SUMMARY OF THE INVENTION

The present invention pertains to an apparatus for shaving. The apparatus for shaving comprises blade means which comprises at least one blade having an essentially straight and essentially continuous cutting edge. The blade is comprised of a plurality of pliable blade segments aligned adjacent to each other to form the cutting edge such that each blade segment is capable of deflecting in a direction perpendicular to the cutting edge independently with respect to the other blade segments. The apparatus is also comprised of a rectangular shaped head which holds the blade in a desired orientation. Additionally, the apparatus is comprised of a handle connected to the head. In a preferred embodiment, there can be two or more blades held in the head in a tandem relationship. Preferably, the head holds the blade such that the blade segments are freestanding and not prestressed.

In an alternative embodiment, the head can include a styptic strip disposed along the length of the head in parallel with the cutting edge and above the cutting edge such that after the cutting edge passes over the shaving surface during shaving, the styptic strip passes over the surface. Additionally, the head can include a lubricating strip disposed along the length of the head in parallel with the cutting edge and below the cutting edge such that before the cutting edge passes over the surface during shaving, the lubricating strip passes over the cutting edge.

In another preferred embodiment, the apparatus can include a styptic stick. In this embodiment, the handle has a hollow portion for receiving and removably storing the styptic stick. The handle has an open end through which the styptic stick can be inserted into the hollow portion.

In an even more preferred embodiment, the blade can have a plurality of holes whose centers are in spaced relationship with the cutting edge.

The present invention also pertains to an apparatus for cutting. The apparatus comprises a first portion. The first portion is of a planar shape and has a first side. The apparatus is also comprised of a plurality of blade segments extending from the first side and aligned adjacent to each other to form a cutting edge such that each blade segment is capable of being deflected in a direction perpendicular to the cutting edge independently with respect to the other blade segments by a surface while in contact with the surface during cutting of the surface. The cutting edge defines an essentially straight line.

BRIEF DESCRIPTION OF THE DRAWINGS

In the accompanying drawings, the preferred embodiment of the invention and preferred methods of practicing the invention are illustrated in which:

FIG. 2 is a schematic representation of a portion of the apparatus for shaving adjacent a portion of skin with whiskers.

FIGS. 3A–3D are schematic representations of a blade as it moves across skin with whiskers.

FIG. **4*a*** is a schematic representation of an alternative embodiment of the apparatus for shaving.

FIG. **4*b*** is a bottom view of a handle of the apparatus for shaving.

Figure 5:
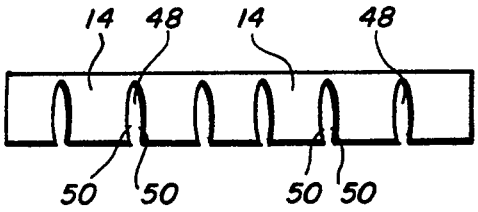

FIG. 5 is a schematic representation of several blade segments of a blade.

Figure 6:
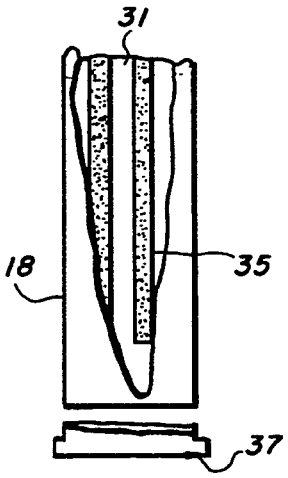

FIG. 6 is a schematic representation of an exposed view of a portion of the handle with a styptic stick therein.

Figure 7:
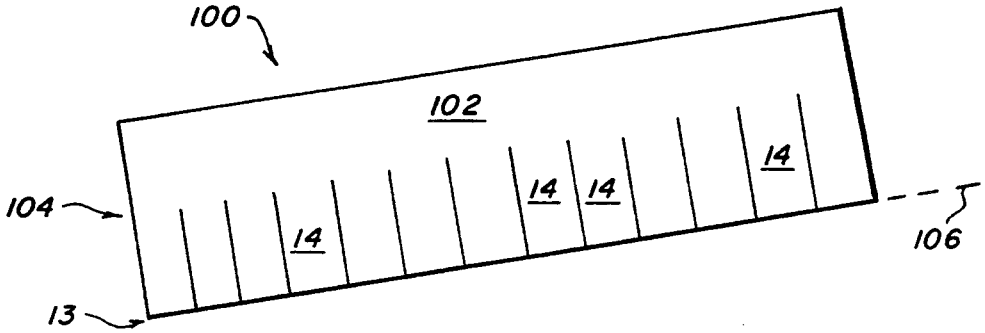

FIG. 7 is a schematic representation of a cutting apparatus.

DESCRIPTION OF THE PREFERRED EMBODIMENT

Figure 1:
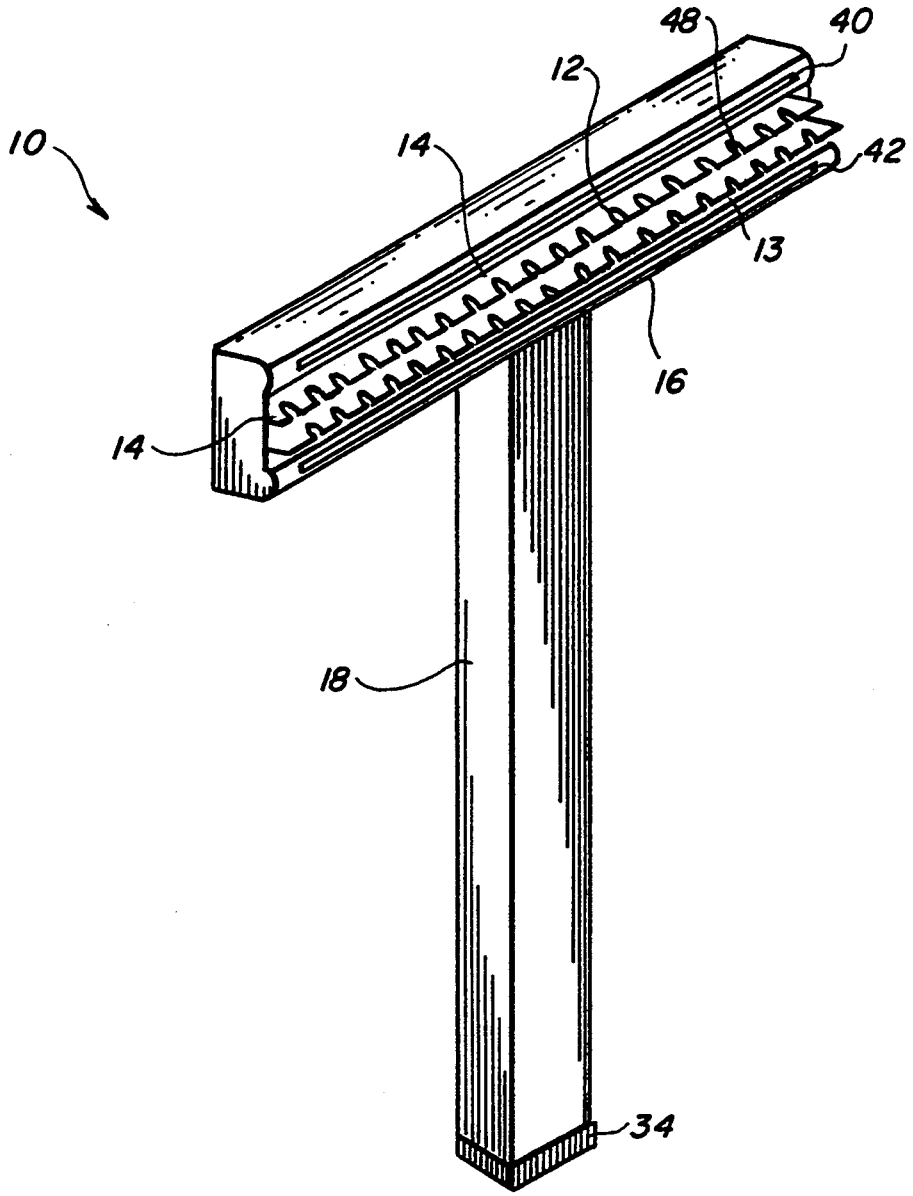
FIG. 1 is a perspective schematic representation of an apparatus for shaving.

Referring now to the drawings wherein like reference numerals refer to similar or identical parts throughout the several views, and more specifically to FIG. 1 thereof, there is shown an apparatus 10 for shaving. The apparatus 10 comprises blade means which comprises at least one blade 12 having preferably an essentially straight and essentially continuous cutting edge 13. The blade 12 is comprised of a plurality of pliable blade segments 14 aligned adjacent to each other to form the cutting edge 13. This blade construction allows each blade segment 14 to deflect in a direction perpendicular to the cutting edge 13 independently with respect to the other blade segments 14. Thus, during shaving, when the blade encounters a variance in skin/surface contour within the dimension of the blade, the particular blade segments 14 can deflect to allow the other blade segments 14 to remain in continuous contact with the skin and have less likelihood of unintentionally cutting or nicking the surface.

The apparatus 10 also comprises a rectangular shaped head 16 for holding the blade 12 in the proper orientation and a handle 18 connected to the head 16. The blade can be held by the head along its sides, along its back opposing its cutting edge 13, or both. The blade can be held by the head 16 in a flexible mounting such as that of the Schick Tracer TM, with, for instance, a head 16 being made out of a polymer type material. The flexible material affords a further degree of automatic adjustability to the blade so the skin/surface can be more closely contacted across the blade during shaving. Preferably, the head holds the blade such that the blade segments are freestanding and not prestressed.

Preferably, the apparatus 10 comprises two blades 12 which are disposed in the head 16 in a tandem relationship. Preferably, the blade segments 14 of one blade 12 are offset from the blade segments 14 of the other blade 12. This offset arrangement allows the blades 12 to shave closer to the skin/surface along the variation in contour than would otherwise be obtainable if the blade segments 14 of each blade 12 were aligned and not miss spots due to deflection of other blade segments or gaps between blade segments. Preferably, the head 16 is removably connected to the handle 18 such that once the blades become dull and/or soiled, the head 16 can be removed and new head 16 can be installed on the handle in its place as is well known in the art.

Figure 4A:
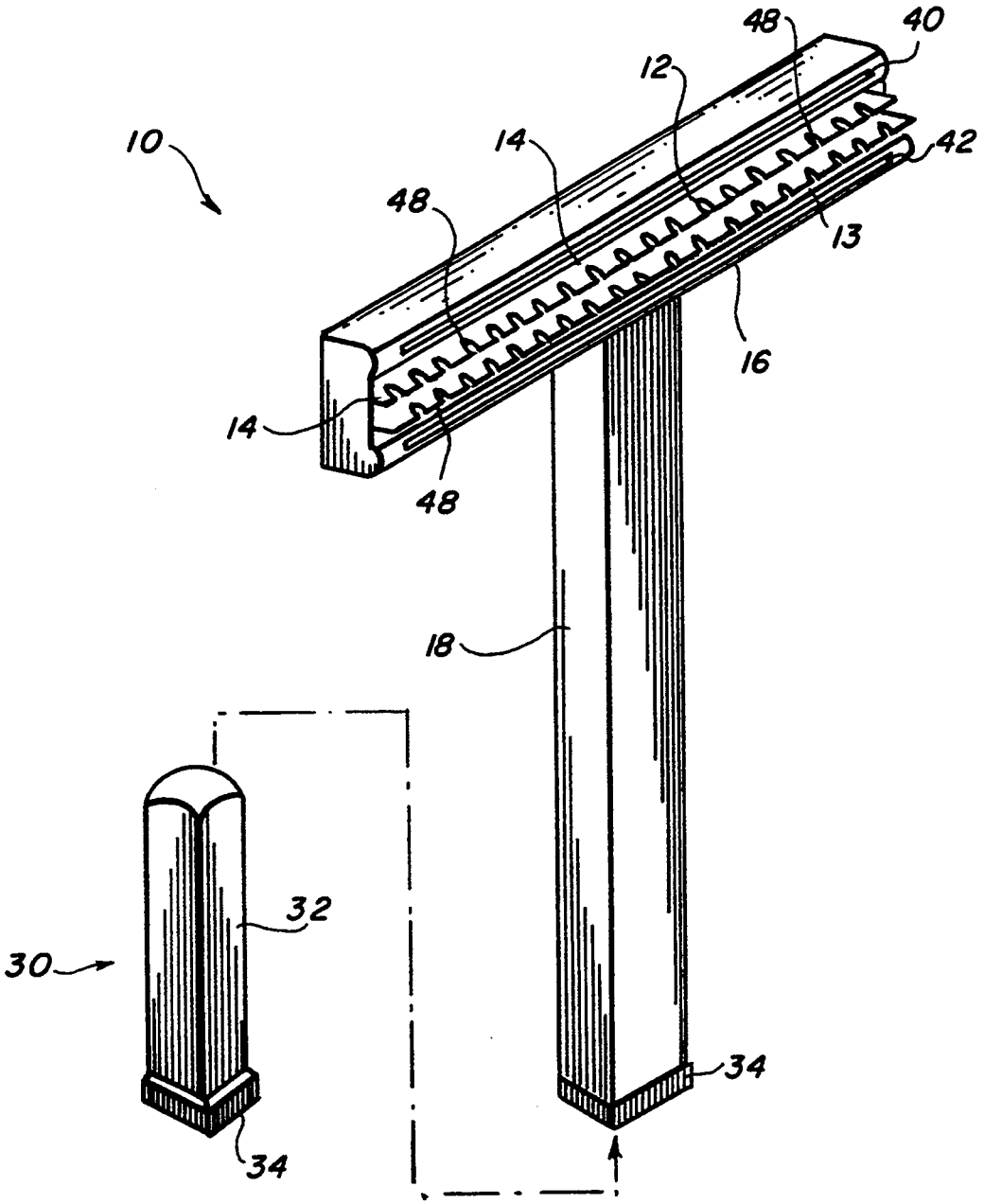

As shown in FIG. 2, each blade 12 preferably comprises a strip 20 to which the blade segments 14 are integrally attached, although this blade can be formed of individual segments 14 individually attached to the head 16 as shown in FIG. 4*a*. In this manner, the blade segments 14 can be formed by cutting a series of slices partially through the pliable blade 12. The blade segments 14 can be cut individually, or preferably in groups simultaneously, using standard machining tools, lasers or ultra precise water jets. There should be as little space as possible between the segments 14 to maximize the overall cutting surface and not miss spots. The gap between each blade segment 14 along the cutting edge 13 is preferably no greater than 1/16" and in general about 1/132". The individual segments 14 when formed should also be as smoothly and cleanly cut as possible to provide less risk of nicks and permit blades to move independently without restriction. The segments 14 are preferably less than $\frac{1}{4}$ inches across. The blade 12 is preferably comprised of stainless steel so that it does not oxidize.

In the operation of the apparatus 10 for shaving, the independent deflection action of the blade segments 14 permits greater degrees of conformability to contours than previously known. During shaving, and as shown in FIG. 2, when the blade 12 encounters a ridge 22 on a shaving surface 24, such as skin, the blade segment 14 adjacent to the ridge 22 deflects thereby allowing the remaining blade segments 14 to stay in contact with the shaving surface 24 to continue shaving. FIGS. 3A–3D show side views of a blade segment 14 as it encounters a ridge. In FIG. 3A, the blade segment 14 is shaving normally cutting the hair stubble 26 from the shaving surface 24. FIG. 3B shows the blade segment 14 as it encounters the ridge 22. Since the blade segment 14 is pliable, continued forward motion causes the blade segment to deflect as shown in FIG. 3C. In this manner, the blade segments 14 can "ride-over" the ridge 22 and have less harm of nicks and permit the blades to move independently while the other blade segments remain in contact with the skin/surface to continue normal shaving. Eventually, as shown in FIG. 3D, the blade segment 14 springs back to its original position in alignment with the other blade segments 14.

Figure 4B:
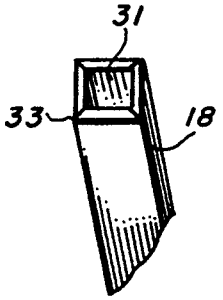

The apparatus 10 can also include a styptic stick 30. The handle 18 connected to the head 16 then has a hollow portion 31 for receiving and removably storing the styptic stick 30. The handle 18 has an open end 33 through which the styptic stick 30 can be inserted into the hollow portion 31, as shown in FIG. 4*b*. The styptic stick 30 can have an elongate portion 32 which is comprised of styptic material and a platform 34 to which the elongate portion 32 is fixedly attached. The platform 34 is preferably of a shape that conforms with the opened end 33 of the handle 18 such that when the elongate portion 32 is inserted into the hollow portion 31, and the platform 34 is fitted into the open end 31 of the handle 18, the platform 34 forms a friction fit with the opened end 33 and is releasably held in the handle 18 by the opened end 33. Other closure mechanisms can be used to maintain the styptic stick 30 in the handle 18 until needed, such as by the platform 34 being screwed onto threads at the open end 33 of the handle. Preferably, the hollow portion 31 receives at least one standard styptic stick 35, or a portion thereof, that is individually inserted therein. A cap 37 closes the hollow portion 35 and maintains the styptic stick 35 therein. When needed, the cap 37 is separated from the handle 18 and the styptic stick is removed from the hollow portion 31.

Alternatively, the head 16 can have a styptic strip 40 disposed along the length of the head 16 in parallel with the cutting edge 13 and above the cutting edge 13 such that after the cutting edge 13 passes over the shaving surface 24, the styptic strip 40 passes over the shaving surface 24. The head 16 could also include a lubricating strip 42. The lubricating strip 42 is disposed along the length of the head 16 in parallel with the cutting edge 13 and below the cutting edge 13 such that before the cutting edge 13 passes over the shaving surface 24, the lubricating strip 42 passes over the shaving surface 24. The lubricating strip 42 can be made of Teflon ® as is well known in the art. The styptic strip 40 can be made part of the head 16 in the same manner as the lubricating strip 42 is made a part of the head 16. Or, the styptic strip 40 can have a backing which is adhered to the head 16, or slide into a slot of the head 16.

As an additional feature of the apparatus 10, a blade 12 can have a plurality of holes 48 whose centers are in spaced relationship with the cutting edge 13. The holes can be, for example, circular having a diameter of $\frac{1}{8}$" or less, or ellipsoidal in shape or forms thereof- Preferably, each blade segment 14 has at least one opening 50 which is disposed to align with an opening 50 of an adjacent blade segment 14 to define the plurality of holes 48 in the blade segment 14, as shown in FIG. 5. The holes facilitate the flow of shaving cream, cut whiskers, etc. therethrough and thus prevent the buildup of the same which may degrade the quality of the shave with the apparatus 10. The holes 48 also can provide greater flexibility and independent movement of the blade segments 14.

The present invention also pertains to an apparatus 100 for cutting. The apparatus 100 comprises a first portion 102. The first portion is of a planar shape and has a first side 104. The apparatus 100 is also comprised of a plurality of blade segments 14 extending from the first side 104 and aligned adjacent to each other to form a cutting edge such that each blade segment 14 is capable of being deflected in a direction perpendicular to the cutting edge 13 independently with respect to the other blade segments 14 by a surface while in contact with the surface during cutting of the surface. The cutting edge 13 defines an essentially straight line 106. The cutting apparatus 100 can be used in the head 16 of the shaving apparatus 10.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for shaving comprising:

blade means which comprises at least one blade having an essentially straight and essentially continuous edge, said blade comprised of a plurality of pliable blade segments aligned adjacent to each other to form the straight and essentially continuous cutting edge such that each blade segment is capable of being deflected in a direction perpendicular to the cutting edge independently with respect to the other blade segments by a surface while in contact with the surface during shaving of the surface;

a rectangular shaped head which holds said blade in a desired orientation, said head having a styptic strip disposed along the length of the head in parallel with the cutting edge and above the cutting edge such that after the cutting edge passes over the surface, the styptic strip passes over the surface; and a handle connected to said head.

2. An apparatus as described in claim 1 wherein two blades are held in the head in a tandem relationship.

3. An apparatus as described in claim 2 wherein the blade segments of one blade are offset from the blade segments of the other blade.

4. An apparatus as described in claim 3 wherein the head is removably connected to said handle.

5. An apparatus as described in claim 1 wherein the blade comprises a strip to which the blade segments are integrally connected.

6. An apparatus as described in claim 5 wherein the blade is made of stainless steel.

7. An apparatus as described in claim 1 wherein the head includes a lubricating strip disposed along the length of the head in parallel with the cutting edge and below the cutting edge such that before the cutting edge passes over the surface, the lubricating strip passes over the surface.

8. An apparatus for shaving comprising:

blade means which comprises at least one blade having an essentially straight and essentially continuous cutting edge, said blade comprised of a plurality of pliable blade segments aligned adjacent to each other to form the straight and essentially continuous cutting edge such that each blade segment is capable of being deflected in a direction perpendicular to the cutting edge independently with respect to the other blade segments by a surface while in contact with the surface during shaving thereof, and a strip to which each blade segment is integrally attached;

a rectangular shaped head which holds said blade in a desired orientation, said head made of a flexible material;

a styptic stick; and a handle connected to said head, said handle having a hollow portion for receiving and removably storing the styptic stick, said handle having an open end through which the styptic stick can be inserted into the hollow portion.

9. An apparatus for shaving comprising:

at least one blade means which comprises at least one blade having a cutting edge, said blade comprised of a plurality of pliable blade segments aligned adjacent to each other to form the cutting edge such that each blade segment is capable of being deflected in a direction perpendicular to the cutting edge independently with respect to the other blade segments by a surface while in contact with the surface during shaving of the surface, said blade having a plurality of holes whose center are in spaced relationship with the cutting edge;

a head which holds said blade in a desired orientation such that the blade segments are freestanding and not prestressed; and a handle connected to said head.

10. An apparatus as described in claim 9 wherein each blade segment has at least one opening which is disposed to align with an opening of an adjacent blade segment to define the plurality of holes in the blade.

11. An apparatus as described in claim 10 wherein said head having a styptic strip disposed along the length of the head in parallel with the cutting edge and above the cutting edge such that after the cutting edge passes over the surface, the styptic strip passes over the surface.

12. An apparatus as described in claim 11 wherein two blades are held in the head in a tandem relationship.

13. An apparatus as described in claim 12 wherein the blade segments of one blade are offset from the blade segments of the other blade.

14. An apparatus as described in claim 13 wherein the head is removably connected to said handle.

15. An apparatus as described in claim 10 wherein the blade comprises a strip to which the blade segments are integrally connected.

16. An apparatus as described in claim 15 wherein the blade is made of stainless steel.

17. An apparatus as described in claim 10 wherein the head includes a lubricating strip disposed along the length of the head in parallel with the cutting edge and below the cutting edge such that before the cutting edge passes over the surface, the lubricating strip passes over the cutting edge.

18. An apparatus for cutting comprising:

a first portion, said first portion of a planar shape and having a first side; and a plurality of blade segments extending from the first side and aligned adjacent to each other to form a cutting edge such that each blade segment is capable of being deflected in a direction perpendicular to the cutting edge independently with respect to the other blade segments by a surface while in contact with the surface during cutting of the surface, said cutting edge defining an essentially straight line.

19. An apparatus for shaving comprising:

blade means which comprises at least one blade having an essentially straight and essentially continuous edge, said blade comprised of a plurality of pliable blade segments aligned adjacent to each other to form the straight and essentially continuous cutting edge such that each blade segment is capable of being deflected in a direction perpendicular to the cutting edge independently with respect to the other blade segments by a surface while in contact with the surface during shaving of the surface, said blade having a plurality of holes whose center are in spaced relationship with the cutting edge;

a rectangular shaped head which holds said blade in a desired orientation, said head having a styptic strip disposed along the length of the head in parallel with the cutting edge and above the cutting edge such that after the cutting edge passes over the surface, the styptic strip passes over the surface; and a handle connected to said head.

20. An apparatus for shaving comprising:

blade means which comprises at least one blade having an essentially straight and essentially continuous edge, said blade comprised of a plurality of pliable blade segments aligned adjacent to each other to from the straight and essentially continuous cutting edge such that each blade segment is capable of being deflected in a direction perpendicular to the cutting edge independently with respect to the other blade segments by a surface while in contact with the surface during shaving of the surface, said blade having a plurality of holes whose center are in spaced relationship with the cutting edge;

a rectangular shaped head which holds said blade in a desired orientation, said head having a styptic strip disposed along the length of the head in parallel with the cutting edge and above the cutting edge such that after the cutting edge passes over the surface, the styptic strip passes over the surface, said head having a lubricating strip disposed along the length of the head in parallel with the cutting edge and below the cutting edge such that before the cutting edge passes over the surface, the lubricating strip passes over the surface;

a styptic stick; and a handle connected to said head, said handle having a hollow portion for receiving and removably storing the styptic stick, said handle having an open end through which the styptic stick can be inserted into the hollow portion.

21. An apparatus for shaving comprising:

at least one blade means which comprises at least one blade having a cutting edge, said blade comprised of a plurality of pliable blade segments aligned adjacent to each other to form the cutting edge such that each blade segment is capable of being deflected in a direction perpendicular to the cutting edge independently with respect to the other blade segments by a surface while in contact with the surface during shaving of the surface;

a head which holds said blade in a desired orientation such that the blade segments are freestanding and not prestressed, said head having a lubricating strip disposed along the length of the head in parallel with the cutting edge and below the cutting edge such that before the cutting edge passes over the surface, the lubricating strip passes over the surface; and a handle connected to said head.

22. An apparatus for shaving comprising:

blade means which comprises at least one blade having an essentially straight and essentially continuous edge, said blade comprised of a plurality of pliable blade segments aligned adjacent to each other to form the straight and essentially continuous cutting edge such that each blade segment is capable of being deflected in a direction perpendicular to the cutting edge independently with respect to the other blade segments by a surface while in contact with the surface during shaving thereof, said blade having a plurality of holes whose center are in spaced relationship with the cutting edge;

a rectangular shaped head which holds said blade in a desired orientation, said head made of a flexible material;

a styptic stick; and a handle connected to said head, said handle having a hollow portion for receiving and removably storing the styptic stick, said handle having an open end through which the styptic stick can be inserted into the hollow portion.

23. An apparatus for shaving comprising:

blade means which comprises at least one blade having a cutting edge, said blade comprised of a plurality of pliable blade segments aligned adjacent to each other to form the cutting edge such that each blade segment is capable of being deflected in a direction perpendicular to the cutting edge independently with respect to the other blade segments by a surface while in contact with the surface during shaving of the surface, said blade having a plurality of holes whose center are in spaced relationship with the cutting edge;

a head which holds said blade in a desired orientation such that the blade segments are freestanding and not prestressed; and a handle connected to said head, said blade having a plurality of holes whose center are in spaced relationship with the cutting edge.

24. An apparatus as described in claim 23 wherein said cutting edge of said blade being an essentially straight and essentially continuous cutting edge, with the plurality of pliable blade segments aligned adjacent to each other to form the essentially straight and essentially continuous cutting edge.

* * * * *